US010276114B2

(12) United States Patent
Zeng

(10) Patent No.: US 10,276,114 B2
(45) Date of Patent: Apr. 30, 2019

(54) DISPLAY DEVICE AND CONTROL METHOD THEREOF

(71) Applicant: Shenzhen China Star Optoelectronics Technology Co., Ltd., Shenzhen, Guangdong (CN)

(72) Inventor: Dekang Zeng, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 124 days.

(21) Appl. No.: 15/301,056

(22) PCT Filed: Jul. 12, 2016

(86) PCT No.: PCT/CN2016/089790
§ 371 (c)(1),
(2) Date: Sep. 30, 2016

(87) PCT Pub. No.: WO2017/201831
PCT Pub. Date: Nov. 30, 2017

(65) Prior Publication Data

US 2018/0144700 A1 May 24, 2018

(30) Foreign Application Priority Data

May 26, 2016 (CN) ..... 2016 1 0362407

(51) Int. Cl.

| | |
|---|---|
| ***G09G 3/20*** | (2006.01) |
| ***G09G 3/36*** | (2006.01) |
| ***G09G 5/00*** | (2006.01) |
| ***G09G 3/3233*** | (2016.01) |

(52) U.S. Cl.
CPC ..... *G09G 3/3648* (2013.01); *G09G 3/20* (2013.01); *G09G 3/3233* (2013.01); *G09G 5/008* (2013.01); *G09G 2310/0286* (2013.01)

(58) Field of Classification Search
CPC ..... G09G 3/3648; G06G 3/3233
See application file for complete search history.

(56) References Cited

U.S. PATENT DOCUMENTS

| | | | | |
|---|---|---|---|---|
| 2002/0047836 | A1* | 4/2002 | Miyazawa | G09G 3/3677 345/204 |
| 2009/0079495 | A1* | 3/2009 | Morita | H02M 3/07 327/538 |
| 2011/0090184 | A1* | 4/2011 | Yamazaki | G09G 3/20 345/204 |

* cited by examiner

*Primary Examiner* — Charles V Hicks
(74) *Attorney, Agent, or Firm* — Andrew C. Cheng

(57) ABSTRACT

A display device and a control method thereof are provided. The display device includes a source module and an array module. The source module includes a receiving unit receiving the image signal and extracting a control signal and a pixel signal from the image signal, a clock signal generating unit generating a plurality of clock signals, wherein periods of each clock signal of the plurality of clock signal are the same and high level periods of each clock signal do not overlap with each other, a level boosting unit boosting a voltage of the extracted control signal and pixel signal to the analog operating voltage, and a digital-to-analog conversion unit converting the voltage of the boosted pixel signal into the grayscale voltage. The array module includes a shift register outputting the pixel signal having the grayscale voltage based on the boosted control signal and the generated plurality of clock signals.

10 Claims, 4 Drawing Sheets

DISPLAY DEVICE AND CONTROL METHOD THEREOF

BACKGROUND OF THE INVENTION

1. Field of the Disclosure

The present invention relates to a display device and a control method thereof, and more particularly, to a display device including a source module and an array module and a control method thereof.

2. Description of the Prior Art

In a display device, digital values are converted into analog operating voltage values using a source module, and the analog voltage values go through the data lines on an array module, thereby displaying pixel signal.

FIG. 1 shows a block diagram of display device 100 according to the prior art.

The display device 100 may include a source module 101 and an array module 109. The source module 101 may include a receiving unit 102, a shift register 103, a line memory 104, a level boosting unit 105, a digital-to-analog conversion unit 106 and an amplifying circuit 107. Differential signal (for example, low voltage differential signal (LVDs) or mini-LVDs) are usually used to transmit image data. The receiving unit 102 is used to convert the received differential signal into digital signal. The shift register 103 is used to convert the digital signal transmitted in serial into digital signal transmitted in parallel. The line memory 104 is used to sequentially store the digital signal according to the displaying location in the display device 100. The level boosting unit 105 boosts a voltage value of the digital signal stored in the line memory 104 to analog operating voltage values. The digital-to-analog conversion unit 106 converts the analog operating voltage values into grayscale voltage values. The amplifying circuit 107 further amplifies the grayscale voltage values to increase the driving capability of the display device 100.

However, the source module 101 usually includes 960 channels, and each channel need an amplifying circuit. When the load of the displaying device is very heavy for a long time, the current of the amplifying circuit will be very large, thereby making the temperature of the source module very high. In some cases, the temperature of the source module may exceed the node temperature, thereby making the source module can't work normally.

SUMMARY

One or more Exemplary embodiments address at least the above disadvantages and other disadvantages not described above. Also, the exemplary embodiments are not required to overcome the disadvantages described above, and the exemplary embodiments may not overcome any of the problems described above.

According to one aspect of the exemplary embodiment of the present invention, a display device is provided, wherein the display device includes a source module and an array module. The source module includes a receiving unit receiving the image signal and extracting the control signal and the pixel signal from among the image signal, a clock signal generating unit generating a plurality of clock signals, wherein periods of each clock signal of the plurality of clock signal are the same and high level periods of each clock signal do not overlap with each other, a level boosting unit boosting a voltage of the extracted control signal and pixel signal to the analog operating voltage, and a digital-to-analog conversion unit converting the voltage of the boosted pixel signal into the grayscale voltage. The array module includes a shift register outputting the pixel signal having the grayscale voltage based on the boosted control signal and the generated plurality of clock signals.

The array module may further include an amplifying circuit amplifying a voltage of the pixel signal having the grayscale voltage output by the shift register to display the image.

The number of the plurality of clock signal may be greater than or equal to 3.

The control signal may be obtained based on the line start signal in the image signal.

When the control signal and the first clock signal of the plurality of clock signals are converted into the high level, the shift register successively outputs the corresponding pixel signals during a high level of each clock signal of the plurality of clock signals.

The level boosting unit and the digital-to-analog conversion unit may use two channels which are respectively positive and negative.

According to another aspect of the exemplary embodiment of the present invention, a method of controlling a display device is provided, wherein the display device includes a source module and an array module. The method include: the source module receives the image signal and extracting the control signal and the pixel signal from among the image signal; the source module generates a plurality of clock signals, wherein periods of each clock signal of the plurality of clock signal are the same and high level periods of the each clock signal do not overlap with each other; the source module boosts a voltage of the extracted control signal and pixel signal to the analog operating voltage; the source module converts the voltage of the boosted pixel signal into the grayscale voltage; the array module outputs the pixel signal having the grayscale voltage based on the boosted control signal and the generated plurality of clock signals.

The number of a plurality of clock signal may be greater than or equal to 3.

The array module may amplify a voltage of the output pixel signal having the grayscale voltage to display the image.

The source module may obtain the control signal based on the line start signal in the image signal. The step that the array module outputs the pixel signal having the grayscale voltage may include: when the control signal and the first clock signal of a plurality of clock signals are converted into the high level, the array module successively outputs the corresponding pixel signals during a high level of each clock signal of the plurality of clock signals.

It can improve the utilization rate of the process of the array module and reduce the cost of the source module while improving the problem that the temperature of the source module is over-high, by using the method and the device according to the exemplary embodiments of the present invention.

The other aspects and/or advantages of the general concept of the present invention will be explained in part in the following description, and there are also some parts that will be clear through description, or through the implementation of the general concept of the present invention to be known.

BRIEF DESCRIPTION OF THE DRAWINGS

The above and other purposes and features of the present invention will become more apparent from the following description taken in conjunction with the accompanying drawings, which exemplarily show one example, in which.

DETAILED DESCRIPTION

Figure 1:
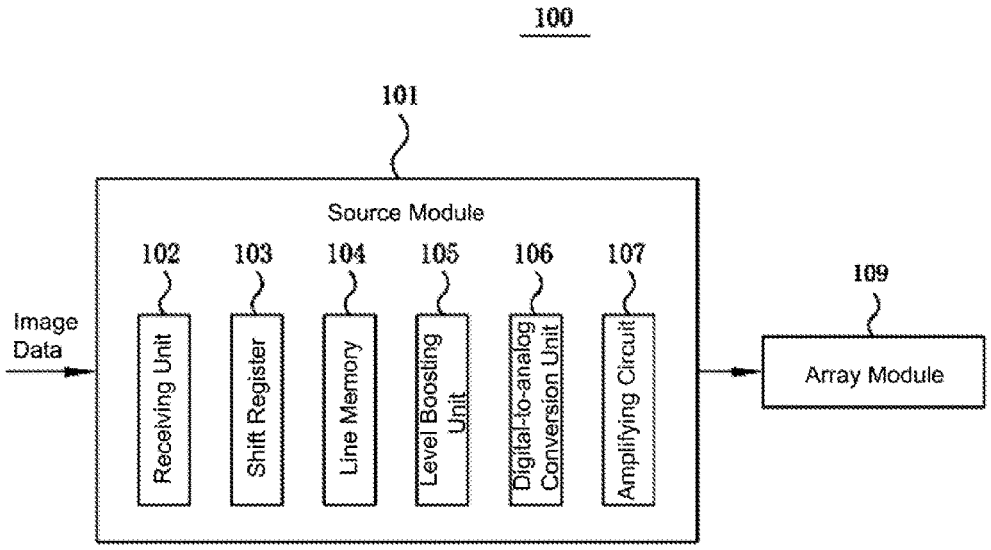
Fig.1 (Prior Art)
FIG. 1 is a block diagram illustrating a displaying device according to the prior art.

Reference will now be made to exemplary embodiments of examples thereof illustrated in the accompanying drawings in detail, and in the accompanying drawings, like reference numerals refer to like elements throughout. In this aspect, the present exemplary embodiments may have different forms, and should not be construed as limited to the descriptions set forth herein. Accordingly, exemplary embodiments will only be described below by referring to the accompanying drawings to explain all aspects of the specification.

Regarding the terms used herein, in the case of considering the functionality in exemplary embodiments the most widely used terms are selected as far as possible; however, these terms may change according to the intention of those skilled in the art and the appearance of cases or new technologies. Some terms used herein are randomly selected by applicant. In this case, these terms will be defined below. Accordingly, it should be based on the unique meaning thereof and the whole context of the present concept to understand the specific terms used herein.

It will be further understood that when the terms "include", "contain" and "have" are used herein, the terms specify the presence of the listed elements, but do not preclude the presence or addition of other elements, unless otherwise defined. In addition, the terms "unit" and "module" used herein refer to an unit for processing at least one function or operation, wherein the units may be implemented by hardware, software or a combination of hardware and software.

Exemplary embodiments will be described in detail below with reference to the accompanying drawings so that one of ordinary skill in the art can easily implement the inventive concepts. However, the inventive concepts can be implemented in many different ways, and should not be construed as limited to the exemplary embodiments set forth herein. In addition, the portions that are independent of the description of exemplary embodiments will be omitted in order to clearly describe exemplary embodiments, and like reference numerals refer to like elements in the whole specification.

Figure 2:
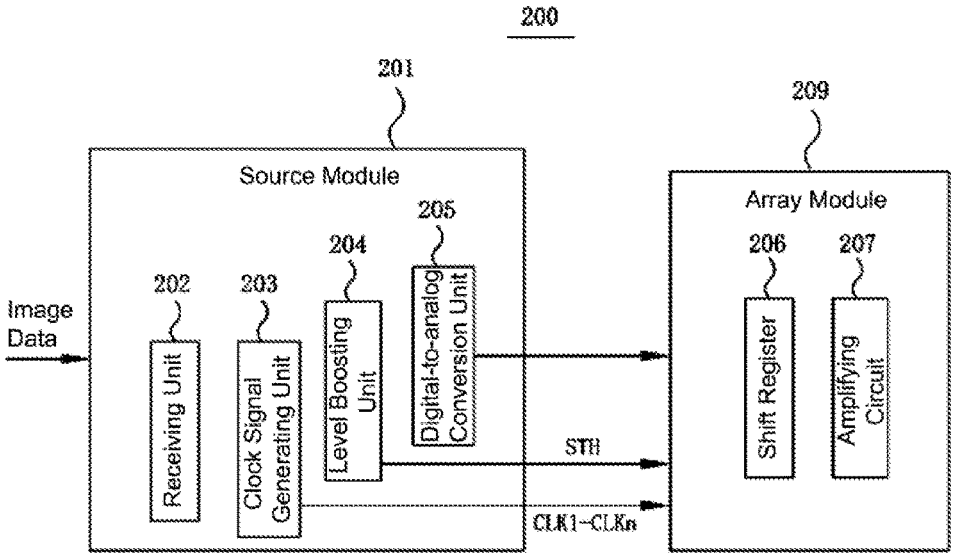
FIG. 2 is a block diagram illustrating a display device according to an exemplary embodiment of the present invention.

FIG. 2 is a block diagram illustrating a display device 200 according to an exemplary embodiment of the present invention.

Referring to FIG. 2, the display device 200 according to an exemplary embodiment of the present invention may include a source module 201 and an array module 207. The source module 201 may include a receiving unit 202, a clock signal generating unit 203, a level boosting unit 204 and a digital-to-analog conversion unit 205. The array module 209 may include a shift register 206 and an amplifying circuit 207.

Here, the display device 200 according to an exemplary embodiment of the present invention may be various types of apparatus with display function, such as smart phones, digital TV, personal computer (PC), portable multimedia player (PMP), personal digital assistant (PDA), navigation device, digital camera, monitor and laptop computer or the like. In addition, any of the following items can be used to implement the display device 200 according to an exemplary embodiment of the present invention: organic light emitting diode (OLED), liquid crystal display (LCD) and active matrix organic light emitting diode (AMOLED). Hereinafter, a display device using the TFT-LCD to implement as an example will be described. However, it is apparent to those skilled in the art that the display device 200 according to an exemplary embodiment of the present invention is not limited thereto.

The receiving unit 202 may receive the image signal and extract the control signal and the pixel signal from among the image signal. Here, image data may be transmitted by using differential signal (for example, low voltage differential signal (LVDs) or mini-LVDs). Hereinafter, exemplary embodiments according to the present invention will be described taking mini-LVDS as an example. When using mini-LVDS to transmit the image data, it can effectively reduce the transmission power consumption and decrease interference in the transmission process.

Figure 4:
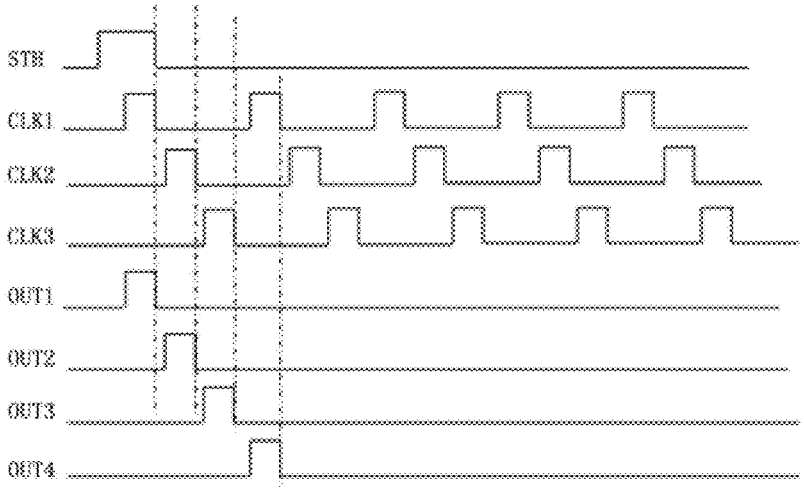
FIG. 4 is a timing diagram illustrating the output of a shift register according to an exemplary embodiment of the present invention.

According to an exemplary embodiment of the present invention, the receiving unit 202 may extract the line start signal of the image signal as a control signal (STH). The receiving unit 202 may also extract pixel signal from the image signal. The clock signal generating unit 203 may generate a plurality of clock signals CLK1-CLKn and provides a plurality of clock signals CLK1-CLKn to the shift register 206. According to an exemplary embodiment of the present invention, the periods of each clock signal of a plurality of clock signal may be the same and the high level periods of each clock signal may not overlap with each other. For example, the period of the clock signal may be the sum of the high level periods of each clock signal of a plurality of clock signals. Referring to FIG. 4, the period of the clock signal may be the sum of the first high level periods of CLK 1, CLK 2 and CLK 3. According to an exemplary embodiment of the present invention, the number of a plurality of clock signal may be greater than or equal to 3.

The level boosting unit 204 boosts the extracted control signal and the pixel signal. In particular, the level boosting unit 204 boosts the extracted control signal and pixel signal to an analog operating voltage (VAA), and provides the control signal having the analog operating voltage to the shift register 206. The digital-to-analog conversion unit 205 may convert the voltage of the boosted pixel signal into the grayscale voltage, and provide the pixel signal having the grayscale voltage to the shift register 206.

According to an exemplary embodiment of the present invention, the shift register 206 may output the pixel signal having the grayscale voltage based on the boosted control signal and the generated multiple clock signals. In particular, when the control signal and the first clock signal of a plurality of clock signals are converted into the high level, the shift register 206 successively outputs the corresponding pixel signals during a high level of each clock signal of a plurality of clock signals.

The line memory can be omitted in the source module by successively outputting the pixel signal having the grayscale voltage based on the extracted control signal and the generated multiple clock signals, thereby capable of saving the production cost of the source module. In addition, in this case, the level boosting unit 204 and the digital-to-analog conversion unit 205 only require two channels which are respectively positive and negative, while each channel (for example, 960 channels) in the display device 100 shown in FIG. 1 respectively requires the respective level boosting unit and the digital-to-analog conversion unit. Thereby, the production cost of the source module can be saved. Hereinafter, the process that the shift register 206 outputs a pixel signal will be described in detail below with reference to FIG. 3 and FIG. 4.

According to an exemplary embodiment of the present invention, the amplifying circuit 107 may amplify the voltage of the pixel signal having the grayscale voltage output by the shift register to display the image. The amplifying circuit 207 may be implemented by the step-by-step amplified operational amplifier (for example, the occasional level operation amplifier circuit). According to an exemplary embodiment of the present invention, it can effectively provide the effective utilization rate of the array module process, and improve the problem that the temperature of the source module is over-high by integrating the shift register 206 and the amplifying circuit 207 into the array module 209.

Figure 3:
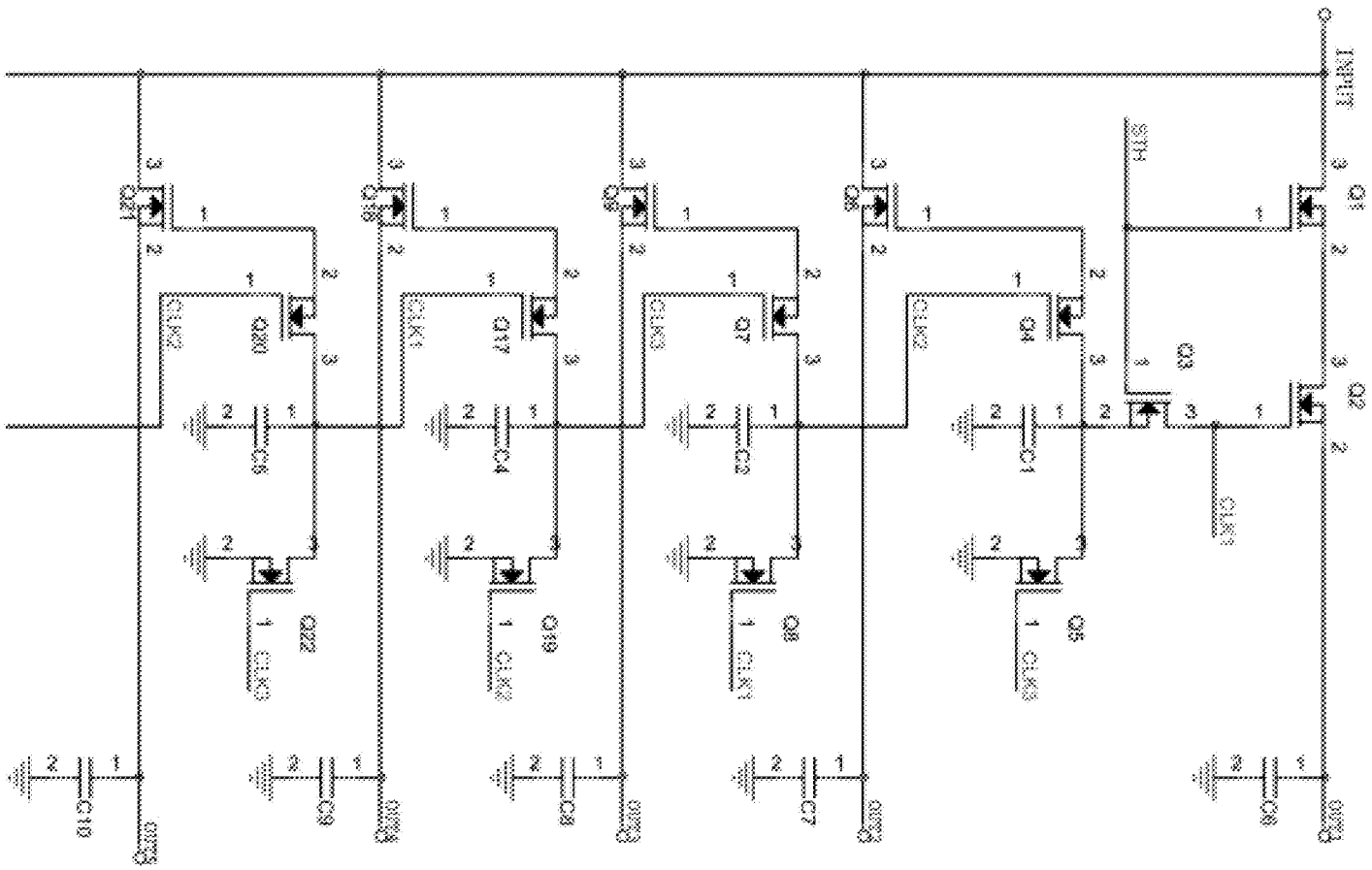
FIG. 3 is a diagram illustrating the circuit of a shift register according to an exemplary embodiment of the present invention.

FIG. 3 is a diagram illustrating the circuit of a shift register 206 according to an exemplary embodiment of the present invention. FIG. 4 is a timing diagram illustrating the output of a shift register 206 according to an exemplary embodiment of the present invention.

As shown in FIG. 3 and FIG. 4, the circuit structure and the output timing diagram of the shift register 206 will be described using the case of three clock signals as the preferred embodiment. However, it is apparent to those skilled in the art that the shift register 206 according to an exemplary embodiment of the present invention is not limited thereto.

In FIG. 3, Q may refer to a transistor, C may refer to a capacitor, INPUT may refer to the input terminal, OUT 1 to OUT 5 may respectively refer to the first output terminal to the fifth output terminal. As shown in FIG. 4, when the level of the control signal (STH) and the level of the first clock (CLK1) are at high levels, the voltage value received by the input terminal (INPUT) (i.e., the pixel signal having the grayscale voltage) may be output by the first output terminal (OUT 1). Meanwhile, CLK1 may charge the C1 so that the potential of the C1 is at a high level.

Subsequently, when the second clock (CLK2) is at a high level, the Q4 is turned on, and the high level of the C1 makes the Q6 turned on, meanwhile, As shown in FIG. 4, the second output terminal (OUT 2) may output the voltage value received by the input terminal (INPUT). At the same time, the CLK2 may charge the C2 so that the potential of the C2 is at a high level. In addition, since the control signal and the first clock are at low levels, Q1, Q2 and Q3 are turned off, and the first output terminal is maintained at the original level.

When the third clock (CLK3) is at a high level, Q5 is turned on, the potential of the C1 is discharged to 0V, and the Q7 is turned on. At this time, the high level of the C2 makes the Q9 turned on, thus, as shown in FIG. 4, the third output terminal (OUT 3) may output the voltage value received by the input terminal (INPUT). At the same time, the CLK3 may charge the C4 so that the potential of the C4 is at a high level, and the CLK2 is at a low level, the Q4 and Q6 are turned off, in this way, the second output terminal is maintained at the original level.

When the first clock (CLK1) become a high level again, the Q8 is turned on, and the potential of the C2 is discharged to 0V. At this time, the potential of the STH is at a low level, thus the first output (OUT 1) can not be electrically connected to the input terminal (INPUT). In addition, the Q17 is turned on, the high potential of the C4 makes the Q18 also turned on, thus as shown in FIG. 4, the fourth output terminal (OUT 4) may output the voltage value received by the input terminal. At the same time, CLK1 may charge the C5 so that the potential of the C5 is at a high level.

In this way, by the continuous cycle of CLK1\CLK2\CLK3, the pixel signals of one line are output by the first output terminal (OUT 1) to the $n^{th}$ output terminal (OUT n). When the next line start signal STH is received, the voltage values received by the input terminal are successively output starting from the first output terminal (OUT 1), until each of the image signals obtains a corresponding voltage.

The first output terminal (OUT 1) to the $n^{th}$ output terminal (OUT n) of the shift register may be connected with the corresponding input terminals in the amplifying circuit respectively.

Figure 5:
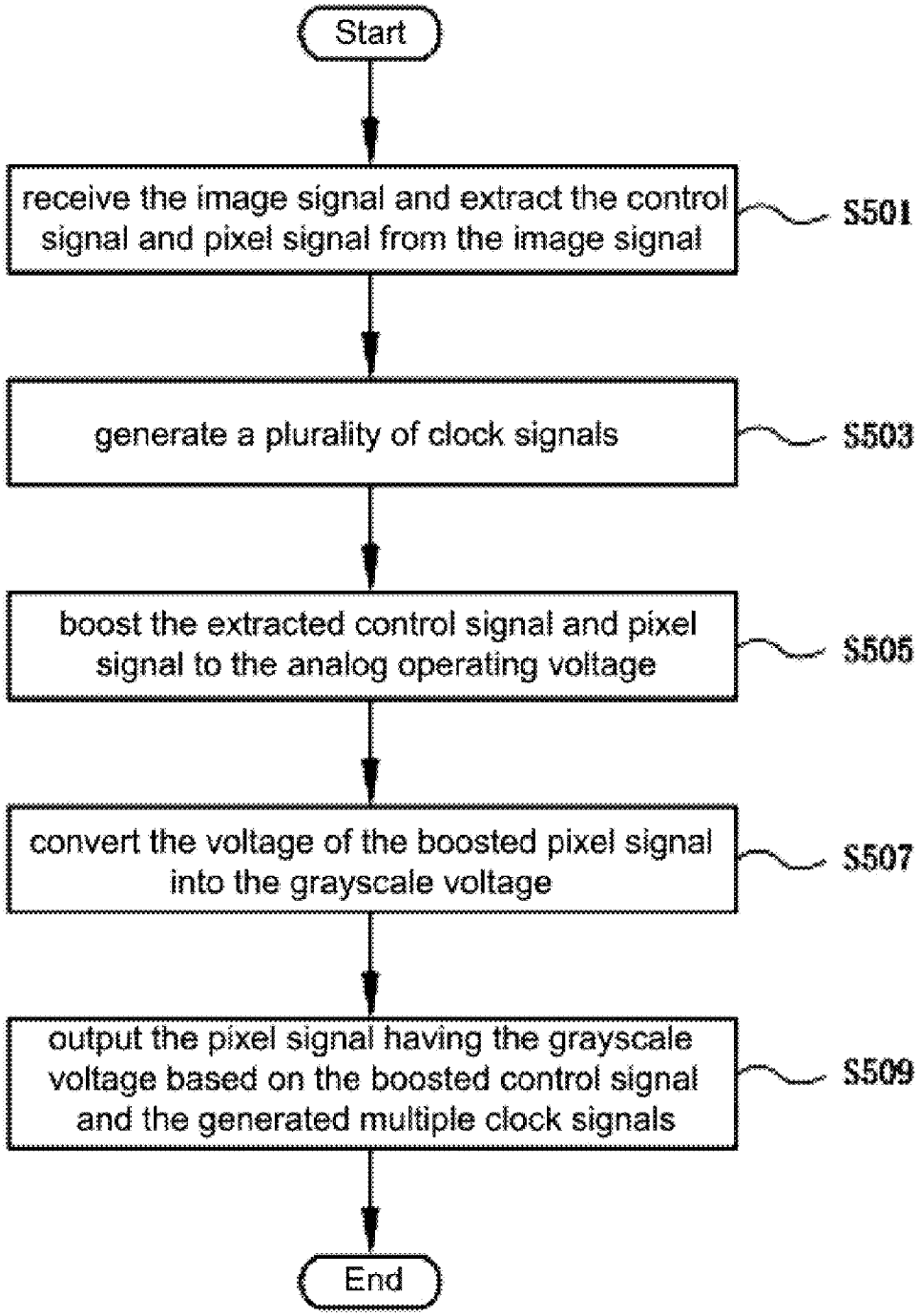
FIG. 5 is a flow chart illustrating a method of controlling a display device according to an exemplary embodiment of the present invention.

FIG. 5 is a flow chart illustrating a method of controlling a display device 200 according to an exemplary embodiment of the present invention.

Referring to FIG. 5, in operation S501, the source module may receive the image signal and extract the control signal and pixel signal from the image signal.

In operation S503, the source module may generate a plurality of clock signals, wherein the periods of each clock signal of a plurality of clock signal are the same and the high level periods of each clock signal do not overlap with each other.

In operation S505, the source module may boost the extracted control signal and pixel signal to the analog operating voltage.

In operation S507, the source module may convert the voltage of the boosted pixel signal into the grayscale voltage.

In operation S509, the array module may output the pixel signal having the grayscale voltage based on the boosted control signal and the generated multiple clock signals.

According to an exemplary embodiment of the present invention, the number of a plurality of clock signal may be greater than or equal to 3. The array module may amplify the voltage of the output pixel signal having the grayscale voltage to display the image.

According to another exemplary embodiment of the present invention, the source module obtains the control signal, based on the line start signal in the image signal.

As another example, when the control signal and the first clock signal of a plurality of clock signals are converted into the high level, the array module successively outputs the corresponding pixel signals during a high level of each clock signal of a plurality of clock signals.

As described above, according to one or more of the exemplary embodiments above, it can improve the utilization rate of the process of the array module and reduce the cost of the source module while improving the problem that the temperature of the source module is over-high.

In addition, other exemplary embodiments may also be implemented through computer-readable code/instructions in/on a medium, e.g., a computer-readable medium, to control at least one processing element to implement any above-described embodiments. The medium may correspond to any medium allowing the storage and/or transmission of the computer-readable code. The computer-readable code can be recorded/transmitted on the medium in a variety of ways, utilizing examples of the medium including recording media (such as magnetic storage media (e.g., ROM, floppy disks, hard disks, etc.) and optical recording media (e.g., CD-ROM or DVD)) and transmission media (such as Internet transmission media). Thus, the medium may have a such defined and measurable structure including or carrying a signal or information according to one or more exemplary embodiments, such as a device carrying a bitstream. The medium may also be a distributed network, so that the computer-readable code is stored/transferred and executed in a distributed fashion. Furthermore, the processing element may include a processor or a computer processor, and the processing element may be distributed and/or included in a single device.

It should be understood that exemplary embodiments described herein should be considered in a descriptive sense only and not for purposes of limitation. Descriptions of features or aspects for each exemplary embodiment should typically be considered as available for other similar features or aspects in other exemplary embodiments. While one or more exemplary embodiments have been described with reference to the accompanying drawings, it will be understood by those skilled in the art that various changes in form and detail may be made therein without departing from the spirit and scope as defined by the appended claims.

What is claimed is:

1. A display device, wherein the display device includes a source module and an array module, wherein the source module includes:

a receiving unit receiving an image signal and extracting a control signal and a pixel signal from the image signal;

a clock signal generating unit generating a plurality of clock signals, wherein periods of the plurality of clock signals are the same and high level periods of the clock signals do not overlap with each other;

a level boosting unit boosting voltages of the extracted control signal and pixel signal to boosted voltages; and a digital-to-analog conversion unit converting the boosted voltage of the pixel signal into a grayscale voltage, and the array module includes:

a shift register outputting the pixel signal having the grayscale voltage based on the boosted voltage of the control signal and the plurality of clock signals generated by the clock signal generating unit;

wherein the digital-to-analog conversion unit is connected to the shift register to supply the grayscale voltage of the pixel signal to the shift register and the shift register has a single input terminal connected to the single output terminal of the digital-to-analog conversion unit to receive the grayscale voltage that is converted from the boosted voltage of the pixel signal.

2. The display device according to claim 1, wherein the array module further includes an amplifying circuit amplifying the pixel signal having the grayscale voltage outputted by the shift register.

3. The display device according to claim 1, wherein a number of the plurality of clock signals is greater than or equal to 3.

4. The display device according to claim 1, wherein the control signal is obtained based on a line start signal in the image signal.

5. The display device according to claim 1, wherein when the control signal and a first clock signal of the plurality of clock signals are converted into high levels, the shift register starts to successively output pixel signals corresponding to clock signals of the plurality of clock signals subsequent to the first clock signal during high levels of the clock signals, respectively.

6. The display device according to claim 1, wherein the level boosting unit and the digital-to-analog conversion unit use two channels which are respectively positive and negative.

7. A method of controlling a display device, wherein the display device includes a source module and an array module, the method including the following steps:

the source module receiving an image signal and extracting a control signal and a pixel signal from the image signal;

the source module generating a plurality of clock signals, wherein periods of the plurality of clock signals are the same and high level periods of the clock signals do not overlap with each other;

the source module boosting voltages of the extracted control signal and pixel signal to boosted voltages;

the source module converting the boosted voltage of the boosted pixel signal into a grayscale voltage; and the array module outputting the pixel signal having the grayscale voltage based on the boosted voltage of the control signal and the plurality of clock signals generated by the clock signal generating unit;

wherein the source module is connected to the array module to supply the grayscale voltage of the pixel signal to the array module and the shift register has a single input terminal connected to the digital-to-analog conversion unit to receive the grayscale voltage that is converted from the boosted voltage of the pixel signal.

8. The method according to claim 7, wherein a number of the plurality of clock signals is greater than or equal to 3.

9. The method according to claim 7, wherein the array module amplifies the pixel signal having the grayscale voltage output therefrom.

10. The method according to claim 7, wherein the source module obtains the control signal based on a line start signal in the image signal, wherein the step of the array module outputting the pixel signal having the grayscale voltage based on the boosted voltage of the control signal and the plurality of clock signals generated by the clock signal generating unit includes: when the control signal and a first clock signal of the plurality of clock signals are converted into high levels, the array module starts to successively output pixel signals corresponding to clock signals of the plurality of clock signals subsequent to the first clock signal during high levels of the clock signals, respectively.

* * * * *